US005669801A

United States Patent [19]

Lee

[11] Patent Number: 5,669,801

[45] Date of Patent: Sep. 23, 1997

[54] FIELD EMISSION DEVICE CATHODE AND METHOD OF FABRICATION

[75] Inventor: Edward C. Lee, Dallas, Tex.

[73] Assignee: Texas Instruments Incorporated, Dallas, Tex.

[21] Appl. No.: 535,505

[22] Filed: Sep. 28, 1995

[51] Int. Cl.[6] ..... H01J 9/02

[52] U.S. Cl. ..... 445/24

[58] Field of Search ..... 445/24, 50, 51

[56] References Cited

U.S. PATENT DOCUMENTS 3,789,471 2/1974 Spindt et al. ..... 445/50 X 4,943,343 7/1990 Bardai et al. ..... 445/24 X

*Primary Examiner*—Kenneth J. Ramsey

*Attorney, Agent, or Firm*—Christopher L. Maginniss; James C. Kesterson; Richard L. Donaldson

[57] ABSTRACT

A microtip of a field emission device cathode (10) may be fabricated by forming a dielectric layer (18) on an upper surface of a resistive layer (16). A gate layer (20) is formed on the dielectric layer (18). An opening is formed in the gate layer (20) and a microtip cavity (28) is formed in the dielectric layer (18). The microtip cavity (28) extends through the opening in the gate layer (20) to the resistive layer (16). Layers of metal are formed on the gate layer (20) and the resistive layer (16) such that a microtip (30) is formed within the microtip cavity (28). Finally, polishing is performed to remove a portion of the overburden or layers of metal on the gate layer (20). The polishing continues until the microtip (30) is exposed.

16 Claims, 2 Drawing Sheets

FIELD EMISSION DEVICE CATHODE AND METHOD OF FABRICATION

TECHNICAL FIELD OF THE INVENTION

The present invention relates in general to electron emitting structures and more particularly to a field emission device cathode and method of fabrication.

BACKGROUND OF THE INVENTION

Field emission display technology may be used in a wide variety of applications including flat panel displays. The technology involves the use of an array of field emission devices. Each field emission device has an anode, cathode, and gate. Each field emission device cathode includes a microtip for emitting electrons. The fabrication of field emission device cathodes requires multiple steps. These fabrication steps are lengthy, require expensive materials, and use complex equipment. The fabrication steps are also demanding and varying, yet still require a high degree of precision.

One common technique for fabricating cathode microtips involves high-angle evaporation of a sacrificial or "lift-off" layer followed by vertical evaporation of the microtip metal. The sacrificial layer is formed on top of the gate and on the edges of an opening in the gate. As the microtip is formed through the opening and inside a cavity, the evaporated microtip metal also builds up on top of the sacrificial layer. The sacrificial layer, along with all of the overburden or subsequent microtip metal layers, is later "lifted-off" to preserve the underlying microtip and structure. The deposition and removal of this sacrificial layer is demanding and critical to proper device operation. One common technique of high-angle evaporation of a sacrificial layer is known as nickel evaporation in which a nickel layer serves as the sacrificial layer. However, the nickel layer tends to grab onto the gate layer, resulting in low reliability of the "lift-off" technique.

Another technique for applying a sacrificial metal layer is electroplating. One technique of electroplating is known as iron-nickel electroplating. Iron-nickel electroplating involves the application of an iron-nickel layer to serve as the sacrificial layer during the fabrication of the cathode microtips. Just as in nickel evaporation, the sacrificial layer protects the integrity of the underlying microtip and structure. The sacrificial layer, along with all of the overburden, is later removed in the "lift-off" process. Nickel evaporation and iron-nickel electroplating are expensive, time consuming, technically challenging, and sometimes unsuccessful. Further, the "lift-off" process does not always provide the desired separation of the nickel layer from the gate layer in order to expose the microtip.

SUMMARY OF THE INVENTION

From the foregoing it may be appreciated that a need has arisen for an improved method of fabricating a field emission device cathode. In accordance with the present invention, a method of fabricating a field emission device cathode is provided which substantially eliminates and reduces disadvantages and problems associated with fabricating field emission device cathodes using sacrificial layers.

According to an embodiment of the present invention, there is provided a method for fabricating a microtip of a field emission device cathode that includes forming a dielectric layer, having an upper surface and a lower surface, on a resistive layer and forming a gate layer on the dielectric layer. The method further includes forming an opening in the gate layer and forming a microtip cavity in the dielectric layer that extends to the resistive layer. The method further includes forming a layer of metal on the gate layer and the resistive layer to produce a microtip positioned on the resistive layer and located within the microtip cavity. The layer of metal on the gate layer is polished until the microtip is exposed.

According to another embodiment of the present invention, a field emission device cathode is provided that includes a substrate layer having an upper surface and a column metal layer having an upper and lower surface such that the lower surface of the column metal layer engages the upper surface of the substrate layer. A resistive layer having an upper and lower surface engages the column metal layer such that the lower surface of the resistive layer engages the upper surface of the column metal layer. A dielectric layer, having an upper and lower surface and a microtip cavity extending from the upper surface to the lower surface of the dielectric layer, engages the resistive layer such that the lower surface of the dielectric layer engages the upper surface of the resistive layer. A microtip having a base and a tip is positioned within the microtip cavity, with the base of the microtip engaging the upper surface of the resistive layer. A gate layer, with an upper and lower surface and a circular opening, engages the dielectric layer such that the lower surface of the gate layer engages the upper surface of the dielectric layer, and the circular opening of the gate layer is positioned above the microtip and microtip cavity. An annular layer of metal engages the interior surface of the circular opening in the gate layer.

The present invention provides various technical advantages over sacrificial layer methods for fabricating field emission device cathodes. For example, one technical advantage of the present invention includes reduced fabrication time due to the elimination of the sacrificial layer step. Another technical advantage includes greater reliability and higher product yields due to the elimination of the sacrificial layer step which may introduce defects in the fabrication process and limit the size of the opening in the gate layer. Yet another technical advantage includes the ability to control the size of the gate layer opening by polishing the gate layer to a predetermined depth. Other technical advantages are readily apparent to one skilled in the art from the following figures, description, and claims.

BRIEF DESCRIPTION OF THE DRAWINGS

For a more complete understanding of the present invention and the advantages thereof, reference is now made to the following description taken in conjunction with the accompanying drawings, wherein like reference numerals represent like parts, in which.

DETAILED DESCRIPTION OF THE INVENTION

Figure 1A:
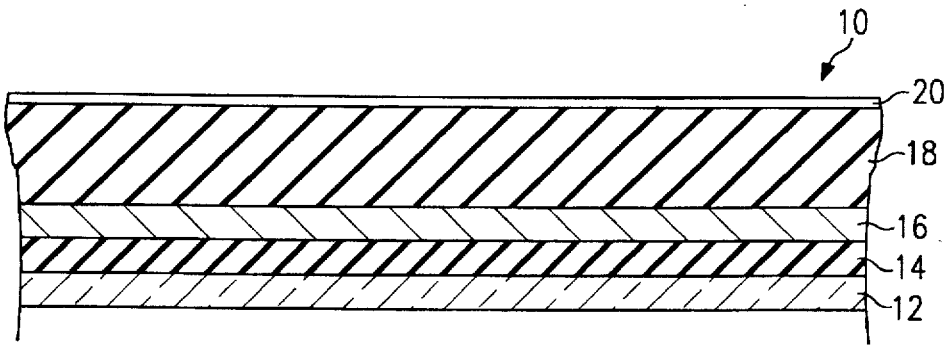
FIGS. 1A–1G illustrate the formation of a microtip of a field emission device cathode.

FIGS. 1A–1G illustrate the various stages occurring during the formation of a microtip of a field emission device cathode 10. FIG. 1A is a cross-sectional view of a preliminary stage during the fabrication of field emission device cathode 10. A substrate layer 12, a column metal layer 14, and a resistive layer 16 are formed one on top of the other. A dielectric layer 18 is formed on an upper surface of resistive layer 16, a gate layer 20 is formed on an upper surface of dielectric layer 18.

Figure 1B:
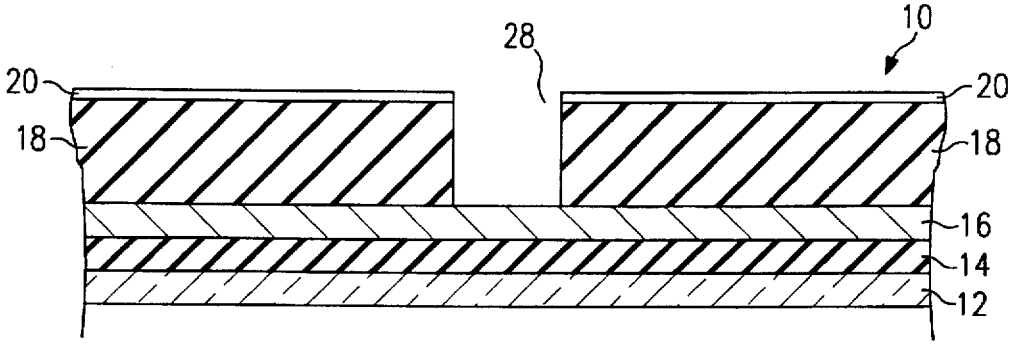

FIG. 1B is a cross-sectional view of a further stage during the formation of field emission device cathode 10. An opening in gate layer 20 is created followed by the formation of a microtip cavity 28 within dielectric layer 18. Microtip cavity 28 extends from gate layer 20 to resistive layer 16.

Figure 1C:
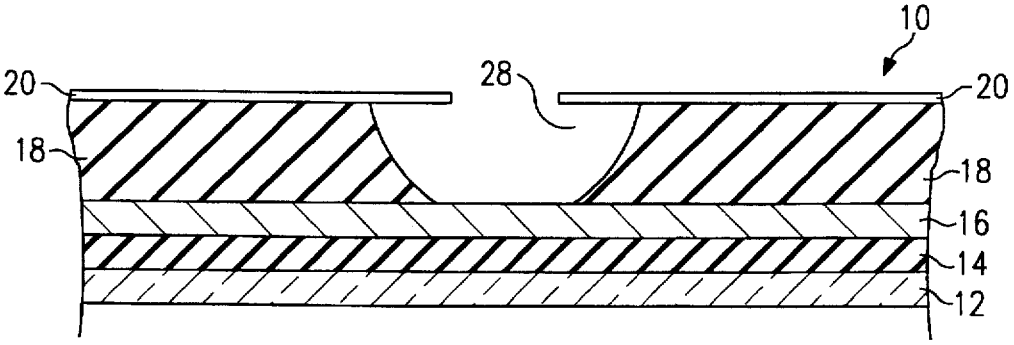

FIG. 1C is a cross-sectional view of yet a further stage during the formation of field emission device cathode 10 which illustrates further development of dielectric layer 18 and microtip cavity 28. Microtip cavity 28 is enlarged by removing additional interior portions of dielectric layer 18 which defines microtip cavity 28. The microtip cavity 28 may be enlarged by any available technique such as wet etching.

Figure 1D:
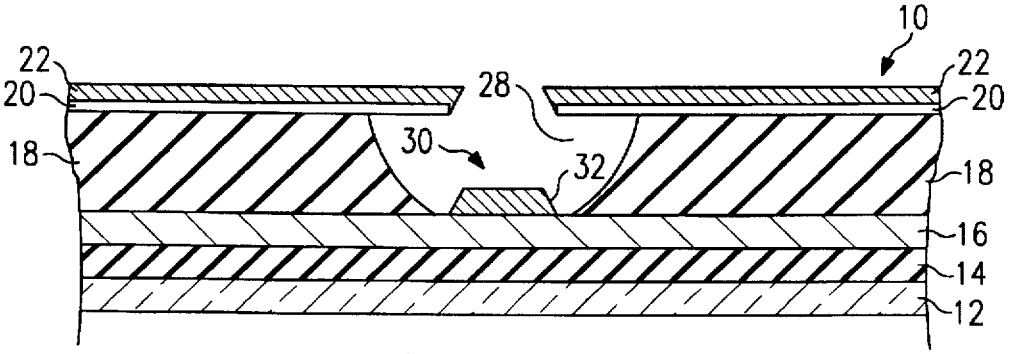

FIG. 1D is a cross-sectional view of another intermediate stage during the fabrication of field emission device cathode 10. FIG. 1D illustrates the beginning of the formation of a microtip 30 within microtip cavity 28. A metal adhesive layer 22 is formed on the upper surface of gate layer 20. The formation of metal adhesive layer 22 also forms a microtip metal adhesive layer 32 within microtip cavity 28. Microtip metal adhesive layer 32 engages the upper surface of resistive layer 16 within microtip cavity 28 and serves as a first layer of microtip 30. As shown in FIG. 1D, the formation of metal adhesive layer 22 also forms on an interior sidewall surface at the opening in gate layer 20.

Figure 1E:
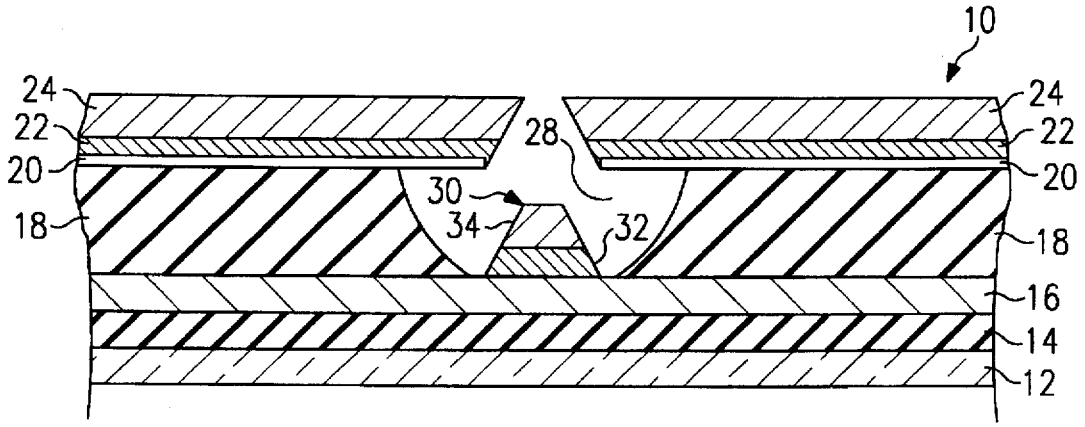

FIG. 1E is a cross-sectional view of yet another intermediate stage during the fabrication of field emission device cathode 10. A first metal layer 24, which may be a refractory metal, is formed on an upper surface of metal adhesive layer 22. The formation of first metal layer 24 also forms a microtip first refractive layer 34 within microtip cavity 28. Microtip first refractive layer 34 engages an upper surface of microtip metal adhesive layer 32. Microtip metal adhesive layer 32 and microtip first refractive layer 34 provide the first two layers of microtip 30. As shown in FIG. 1E, the opening of gate layer 20, leading to microtip cavity 28 and microtip 30, is beginning to close or pinch-off.

Figure 1F:
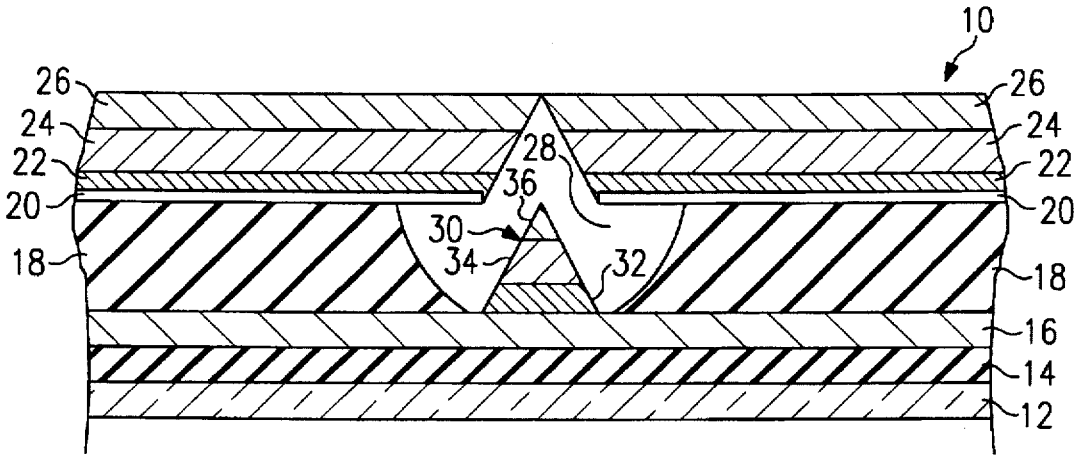

FIG. 1F is a cross-sectional view of still a further stage during the formation of field emission device cathode 10 which illustrates the stage immediately after the formation of microtip 30. A second metal layer 26 is formed on the upper surface of first metal layer 24. The formation of second metal layer 26 forms a microtip second refractive layer 36 of microtip 30. Microtip second refractive layer 36 engages an upper surface of microtip first refractive layer 34 and forms the final layer of microtip 30. The opening to microtip cavity 28 is shown closed or pinched-off.

Figure 1G:
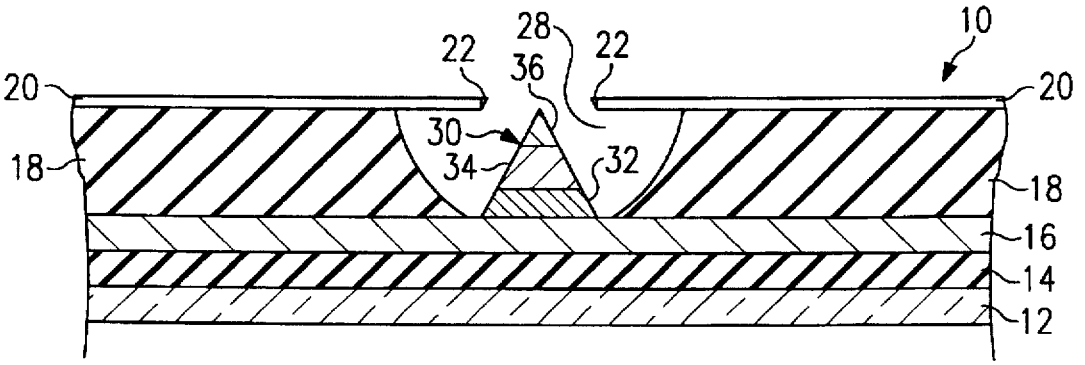

FIG. 1G is a cross-sectional view of the final stage of field emission device cathode 10 which occurs after the application of a polishing step or technique known as chemical mechanical planarization. Chemical mechanical planarization is a polishing technique for removing a portion of a surface to produce a flat surface. Chemical mechanical planarization is applied to second metal layer 26, as shown in FIG. 1F, so that second metal layer 26 is removed and an opening once again exists to microtip cavity 28. Chemical mechanical planarization may be further applied to remove first metal layer 24 and metal adhesive layer 22. As shown in FIG. 1G, a portion of metal adhesive layer 22 remains as an annular layer at the opening of gate layer 20 defined by the interior surface of gate layer 20. Microtip 30 is accessible through the opening in gate layer 20 and includes microtip metal adhesive layer 32, microtip first refractive layer 34, and microtip second refractive layer 36.

In operation, field emission device cathode 10 serves as a supplier of electrons. A potential difference is applied across gate layer 20 and microtip 30. Electrons are emitted from microtip 30 for use in field emission device technology such as flat panel displays.

Any of a variety of materials may be used in the fabrication of field emission device cathode 10. For example, substrate layer 12 may be fabricated from such materials as glass or silicon. Column metal layer 14 may be fabricated using niobium. Resistive layer 16 may include amorphous silicon and dielectric layer 18 may be silicon dioxide. Gate layer 20 may be fabricated from niobium while the various layers of microtip 30 may include such metals as chromium, niobium, and molybdenum. For example, metal adhesive layer 22 may be constructed from chromium with a depth of 1,500 Å, first metal layer 24 may be constructed from niobium with a depth of 7,000 Å, and second metal layer 26 may be constructed from molybdenum with a depth of 15,000 Å.

During the formation process of field emission device cathode 10, as shown in FIGS. 1A–1G, any fabrication or deposition technology may be used to produce these results. For example, such known techniques including metal evaporation, high-angle evaporation, sputtering, etching, and wet etching may all be used during the fabrication process.

Various alternatives to the present invention, as detailed in the one embodiment shown in FIGS. 1A–1G, are discussed more fully below. Microtip 30 is shown in FIG. 1G as having been formed or fabricated from three distinct metal layers. Microtip 30 may be constructed from a single metal or from multiple layers of different metals. The shape of microtip 30 may be conical or exist in any other shape that produces a tip. The formation of the opening in gate layer 20, as depicted in FIG. 1B, may form a circular opening defined by the interior surface of gate layer 20. Accordingly, the portion of metal adhesive layer 22 still attached to the interior sidewall surface of gate layer 20 will then exist as a circular annular layer if the opening of gate layer 20 is a circular opening. The opening in gate layer 20 may be of any geometric shape that encloses an area or substantially encloses an area.

The size of the opening leading to microtip cavity 28 may be varied. FIG. 1F and FIG. 1G illustrate the results of the polishing step or chemical mechanical planarization to create an opening to microtip cavity 28 and microtip 30. Depending on the desired size of the opening, chemical mechanical planarization may be used to a predetermined depth to produce the desired opening size. For example, chemical mechanical planarization may be used to remove second metal layer 26 and a portion of first metal layer 24, hence leaving a smaller opening than that shown in FIG. 1G. Other polishing techniques may be used instead of chemical mechanical planarization. Another alternative in the formation of microtip 30 includes applying metal layers to produce microtip 30 such that the opening of gate layer 20 is never fully "pinched-off" as shown in FIG. 1F.

Another alternative of the present invention, as described in the one embodiment shown in FIGS. 1A–1G, involves the elimination of the gate layer as shown in FIG. 1A. The invention proceeds as shown in FIGS. 1A–1G except that metal adhesive layer 22 is formed directly on dielectric layer 18. An opening to microtip cavity 28 will exist through metal adhesive layer 22. In essence, metal adhesive layer 22, first metal layer 24, and second metal layer 26 serve as the gate layer for field emission device cathode 10. These layers may then be polished to produce a gate layer of a desired depth and an opening in the gate layer of a desired size.

The present invention may also be used in combination with known techniques for fabricating field emission device cathodes. Techniques such as nickel evaporation and iron-nickel electroplating involve the use of a sacrificial layer to remove unwanted overburden layers. For example, referring now to FIG. 1C, a nickel layer, serving as a polish stop layer, may be applied to the upper surface of gate layer 20. The nickel layer is not applied within microtip cavity 28 or to resistive layer 16. Next, microtip 30 may be formed according to the steps illustrated in FIGS. 1D–1F. Metal adhesive layer 22, first metal layer 24, and second metal layer 26 are applied after the polish stop layer. Chemical mechanical planarization is used to remove the desired amount of metal layers to the polish stop layer. For example, second metal layer 26, first metal layer 24, metal adhesive layer 22, and the nickel or polish stop layer may be removed by chemical mechanical planarization to produce the desired field emission device cathode.

In summary, the present invention provides various technical advantages including reduced fabrication time due to the elimination of the requirement of a sacrificial layer. A sacrificial layer is not needed in the present invention because chemical mechanical planarization is used to expose the microtip. The elimination of the sacrificial layer step increases reliability and provides higher product yields due to the elimination of the problems associated with the sacrificial layer step such as short circuits, limited gate layer openings, and non-uniform and incomplete "lift-off." Another advantage of the present invention includes the ability to control the size of the cathode gate opening by controlling the depth of the polishing or chemical mechanical planarization.

Thus, it is apparent that there has been provided, in accordance with the present invention, a field emission device cathode and method of fabrication that satisfy the advantages set forth above. Although the preferred embodiment of the present invention has been described in detail, it should be understood that various changes, substitutions, and alterations can be made herein without departing from the spirit and scope of the present invention as defined by the appended claims.

What is claimed is:

1. A method for fabricating a microtip of a field emission device cathode, comprising the steps of:

forming a dielectric layer, having an upper surface and a lower surface, on a resistive layer;

forming a gate layer on the dielectric layer;

forming an opening in the gate layer;

forming a microtip cavity in the dielectric layer through the opening in the gate layer that extends to the resistive layer;

forming a layer of metal on the gate layer and on the resistive layer to produce a microtip on the resistive layer within the microtip cavity; and polishing off the layer of metal on the gate layer, until the microtip is exposed.

2. The method of claim 1, wherein the polishing step includes using chemical mechanical planarization.

3. The method of claim 1, wherein the forming a layer of metal step includes applying a plurality of successive metal layers to form the microtip.

4. The method of claim 1, wherein the forming a layer of metal step further includes the formation of a metal layer covering the opening.

5. The method of claim 1, wherein the forming a layer of metal step includes forming a layer of metal on an interior sidewall surface of the gate layer at the opening.

6. The method of claim 1, wherein the forming a layer of metal step includes producing a conical microtip.

7. The method of claim 6, wherein the forming a layer of metal step further includes forming a layer of metal on an interior sidewall surface of the gate layer at the opening.

8. The method of claim 1, wherein the forming an opening step includes forming a circular opening, the forming a layer of metal step includes forming a conical microtip and further includes forming an annular layer of metal on an interior sidewall surface of the gate layer at the circular opening, and the polishing step includes using chemical mechanical planarization.

9. The method of claim 1, further comprising the step of forming a polish stop layer of metal on the gate layer and on an interior sidewall surface of the gate layer at the opening before the forming a layer of metal step.

10. The method of claim 9, wherein the forming a polish stop layer step includes using nickel evaporation.

11. The method of claim 9, wherein the forming a polish stop layer step includes using iron-nickel electroplating.

12. The method of claim 1, wherein the polishing step includes polishing the layer of metal to remove a predetermined depth of the layer of metal from the gate layer.

13. The method of claim 12, wherein the forming a layer of metal step further includes forming a layer of metal covering the opening, the polishing step further includes polishing the layer of metal to remove a predetermined depth of the layer of metal so that the layer of metal covering the opening has an aperture of a predefined size.

14. A method for fabricating a microtip of a field emission device cathode, comprising the steps of:

forming a dielectric layer, having an upper surface and a lower surface, on a resistive layer;

forming a microtip cavity in the dielectric layer that extends from the upper surface to the lower surface of the dielectric layer exposing the resistive layer;

forming a layer of metal on the dielectric layer and the resistive layer to produce a microtip on the resistive layer within the microtip cavity, the layer of metal on the dielectric layer creating a gate layer having an opening over the microtip cavity; and polishing the layer of metal with chemical mechanical planarization until the microtip is exposed.

15. The method of claim 14, wherein the forming a layer of metal step includes applying a plurality of successive metal layers to produce the microtip.

16. The method of claim 14, wherein the forming a layer of metal step includes producing a conical microtip.

* * * * *